US007247392B2

(12) United States Patent
Sugano et al.

(10) Patent No.: US 7,247,392 B2
(45) Date of Patent: Jul. 24, 2007

(54) ALUMINUM ALLOY HEAT EXCHANGER AND METHOD OF PRODUCING THE SAME

(75) Inventors: Kazumitsu Sugano, Toyota (JP); Noriyuki Yamada, Tokyo (JP); Akio Niikura, Tokyo (JP); Yoshiaki Ogiwara, Tokyo (JP); Masaki Shimizu, Kariya (JP); Kenji Negura, Kariya (JP); Sunao Fukuda, Kariya (JP); Yoshihiko Kamiya, Kariya (JP)

(73) Assignees: Furukawa-Sky Aluminum Corp., Tokyo (JP); Denso Corporation, Aichi (JP)

( * ) Notice: Subject to any disclaimer, the term of this patent is extended or adjusted under 35 U.S.C. 154(b) by 28 days.

(21) Appl. No.: 10/999,232

(22) Filed: Nov. 30, 2004

(65) Prior Publication Data

US 2005/0153155 A1 Jul. 14, 2005

Related U.S. Application Data

(63) Continuation-in-part of application No. 10/446,150, filed on May 28, 2003, now abandoned.

(30) Foreign Application Priority Data

May 29, 2002 (JP) ..... 2002-156268

(51) Int. Cl.

| | |
|---|---|
| ***B32B 15/20*** | (2006.01) |
| ***F28F 21/08*** | (2006.01) |
| ***B23K 101/14*** | (2006.01) |
| ***B23K 10/06*** | (2006.01) |

(52) U.S. Cl. ..... 428/654; 428/933; 165/180; 165/905; 148/535; 228/183; 228/262.51

(58) Field of Classification Search ..... None
See application file for complete search history.

(56) References Cited

U.S. PATENT DOCUMENTS 5,125,452 A 6/1992 Yamauchi et al.

(Continued)

FOREIGN PATENT DOCUMENTS

| | | | |
|---|---|---|---|
| EP | 0514946 | A2 * | 11/1992 |
| EP | 0 712 681 | A2 | 5/1996 |
| EP | 1 367 353 | A1 | 12/2003 |

(Continued)

OTHER PUBLICATIONS

European Search Report dated Sep. 18, 2003.

*Primary Examiner*—John J. Zimmerman
(74) *Attorney, Agent, or Firm*—Westerman, Hattori, Daniels & Adrian, LLP.

(57) ABSTRACT

An aluminum alloy heat exchanger having a tube composed of a thin aluminum alloy clad material, wherein, in the clad material, one face of an aluminum alloy core material containing Si 0.05–1.0 mass % is clad with an Al—Si-series filler material containing Si 5–20 mass %, and the other face is clad with a sacrificial material containing Zn 2–10 mass % and/or Mg 1–5 mass %, and wherein an element diffusion profile of the clad material by EPMA satisfies (1) and/or (2):

$$L-L_{Si}-L_{Zn} \geqq 40(\mu m) \quad (1)$$

$$L-L_{Si}-L_{Mg} \geqq 5(\mu m) \quad (2)$$

wherein L is a tube wall thickness (μm); $L_{Si}$ is a position (μm) indicating an amount of Si diffused from the filler material; and $L_{Zn}$ and $L_{Mg}$ each represent a region (μm) indicating an amount of Zn or Mg diffused from the sacrificial material, respectively; and a method of producing the heat exchanger.

8 Claims, 3 Drawing Sheets

U.S. PATENT DOCUMENTS

| | | | | |
|---|---|---|---|---|
| 5,292,595 | A * | 3/1994 | Yamauchi et al. | 428/654 |
| 5,350,436 | A * | 9/1994 | Takezoe et al. | 75/314 |
| 6,261,706 | B1 * | 7/2001 | Fukuda et al. | 428/654 |
| 6,316,126 | B1 | 11/2001 | Hasegawa et al. | |
| 2002/0127135 | A1 * | 9/2002 | Ohara et al. | 420/531 |

FOREIGN PATENT DOCUMENTS

| | | | |
|---|---|---|---|
| JP | 10-140278 | * | 5/1998 |
| JP | 2000-084661 | * | 3/2000 |
| JP | 2003-082428 | * | 3/2003 |

* cited by examiner

ALUMINUM ALLOY HEAT EXCHANGER AND METHOD OF PRODUCING THE SAME

This application is a continuation-in-part of application Ser. No. 10/446,150 filed on May 28, 2003 now abandoned.

FIELD

The present invention relates to an aluminum alloy heat exchanger and to a method of producing the same.

BACKGROUND

Heat exchangers for automobile are usually assembled by brazing, using lightweight aluminum alloys as raw materials.

Since it is well known that a heat exchanger for automobile is often used under a severely corrosive condition, the material of the heat exchanger is required to be excellent in corrosion resistance. To solve this problem, corrosion resistance of an aluminum alloy core material has been enhanced, by cladding the aluminum alloy core material with an aluminum alloy skin material (sacrificial anode skin material) having a sacrificial anode effect. As the sacrificial anode skin material having the sacrificial anode effect, one containing Zn, Sn, In, or the like in aluminum in an appropriate amount has been developed.

In the clad material described above, usually, together with the sacrificial anode skin material cladding on one face of the core material, an Al—Si-series alloy filler material is clad on the other face of the core material. It has been developed that a small amount of Zn is contained in the filler material, to give the filler material a sacrificial anode effect, thereby a resulting tube for flowing a refrigerant in which the filler material is utilized is also made to be highly corrosion resistant by this sacrificial corrosion resistant effect.

With respect to external corrosion resistance of a heat exchanger, a potential difference is usually provided between a fin material and the surface of a tube material, thereby the tube is prevented from corrosion by the sacrificial corrosion resistant effect of the fin material.

With respect to the Cu concentration in the aluminum alloy clad material, a concentration gradient is formed in the direction of thickness of the clad sheet, and the Cu concentration gradient is appropriately defined so as to improve external corrosion resistance of the tube.

However, the external corrosion resistance has become insufficient in some cases, even in a heat exchanger equipped with a tube having the sacrificial corrosion resistant effect as described above, or in a heat exchanger equipped with a tube taking advantage of the sacrificial corrosion resistant effect of a fin material as described above. This is conspicuous under current situations in which the thickness of the tube wall is extremely reduced to make the heat exchanger lightweight, particularly in the region where a liquid having a corrosion accelerating property, such as one containing an anti-freeze agent, adheres on the tube.

Such decreased corrosion resistance is caused because grain boundaries are preferentially dissolved due to Si-series compounds precipitated at the grain boundaries, when Si of the filler material on the external surface of the tube material diffuses into the core material. When this preferential dissolving due to the precipitated Si-series compounds invade deep into the tube wall to reach the region in which the sacrificial anode skin material components are diffused into the core material, the resulting reached portion causes pitting corrosion, to lead fetal penetration (through hole) through the tube wall. The sacrificial corrosion resistant effect of the fin material becomes incapable of preventing the tube from corrosion in the situations described above. Further, corrosion cannot be sufficiently suppressed from advancing, even by giving the tube with a corrosion resistant capability, for example, by giving a potential difference by diffusion of Cu in the core material, when the tube wall thickness is thinned to a certain extent.

Accordingly, the corrosion described above should be prevented from invading into the total thickness of the tube wall, to obtain sufficiently high resistance to external corrosion of the heat exchanger when the thickness of the tube wall is required to be as thin as possible.

SUMMARY

The present invention is an aluminum alloy heat exchanger having a tube, wherein the tube is composed of a thin aluminum alloy clad material, in which one face of an aluminum alloy core material having an Si content of 0.05 to 1.0% by mass is clad with an Al—Si-series filler material containing 5 to 20% by mass of Si, and in which the other face of the core material is clad with a sacrificial material containing at least one selected from the group consisting of 2 to 10% by mass of Zn and 1 to 5% by mass of Mg, and wherein an element diffusion profile of the aluminum alloy clad material after heating for brazing as determined by EPMA from a filler material side satisfies the following expression (1) when the sacrificial material contains Zn, and the following expression (2) when the sacrificial material contains Mg:

$$L-L_{Si}-L_{Zn} \geqq 40(\mu m) \quad (1)$$

wherein L represents a thickness (μm) of a wall of the tube;

$L_{Si}$ represents a position (μm) from a filler material surface of a cross point between an elongated line connecting a point corresponding to an Si content of 1.5% by mass and a point corresponding to an Si content of 1.0% by mass, and a line indicating the Si content of the core material, in the diffusion profile by EPMA from the filler material side; and $L_{Zn}$ represents a diffusion region (μm) from a sacrificial material surface, in which an amount of Zn diffused from the sacrificial material is 0.5% by mass or more;

$$L-L_{Si}-L_{Mg} \geqq 5(\mu m) \quad (2)$$

wherein L and $L_{Si}$ have the same meanings as those in the expression (1); and $L_{Mg}$ represents a diffusion region (μm) from a sacrificial material surface, in which an amount of Mg diffused from the sacrificial material is 0.05% by mass or more.

Further, the present invention is a method of producing an aluminum alloy heat exchanger, which comprises the step of:

brazing under heating, which comprises: being kept at a temperature of 600±5° C. for 3 to 4 minutes in a nitrogen atmosphere, and cooling at a cooling down rate from 550° C. to 200° C. of 50±5° C./min, wherein the aluminum alloy heat exchanger has a clad ratio of the filler material of 7% or more and less than 13%, and a clad ratio of the sacrificial material of 4% or more and less than 16.5%, within the range of the above-mentioned clad material components.

Further, the present invention is a method of producing an aluminum alloy heat exchanger, which comprises the step of:

brazing under rapid heating and cooling, which comprises: being kept at a target temperature of 600±5° C. for 3 to 4 minutes in a nitrogen atmosphere, in which a time for keeping at 400° C. or higher is less than 15 minutes, wherein the aluminum alloy heat exchanger has a clad ratio of the filler material of 7% or more and less than 20%, and a clad ratio of the sacrificial material of 4% or more and less than 30%, within the range of the above-mentioned clad material components.

Other and further features and advantages of the invention will appear more fully from the following description, taken in connection with the accompanying drawings.

DETAILED DESCRIPTION

Figure 1:
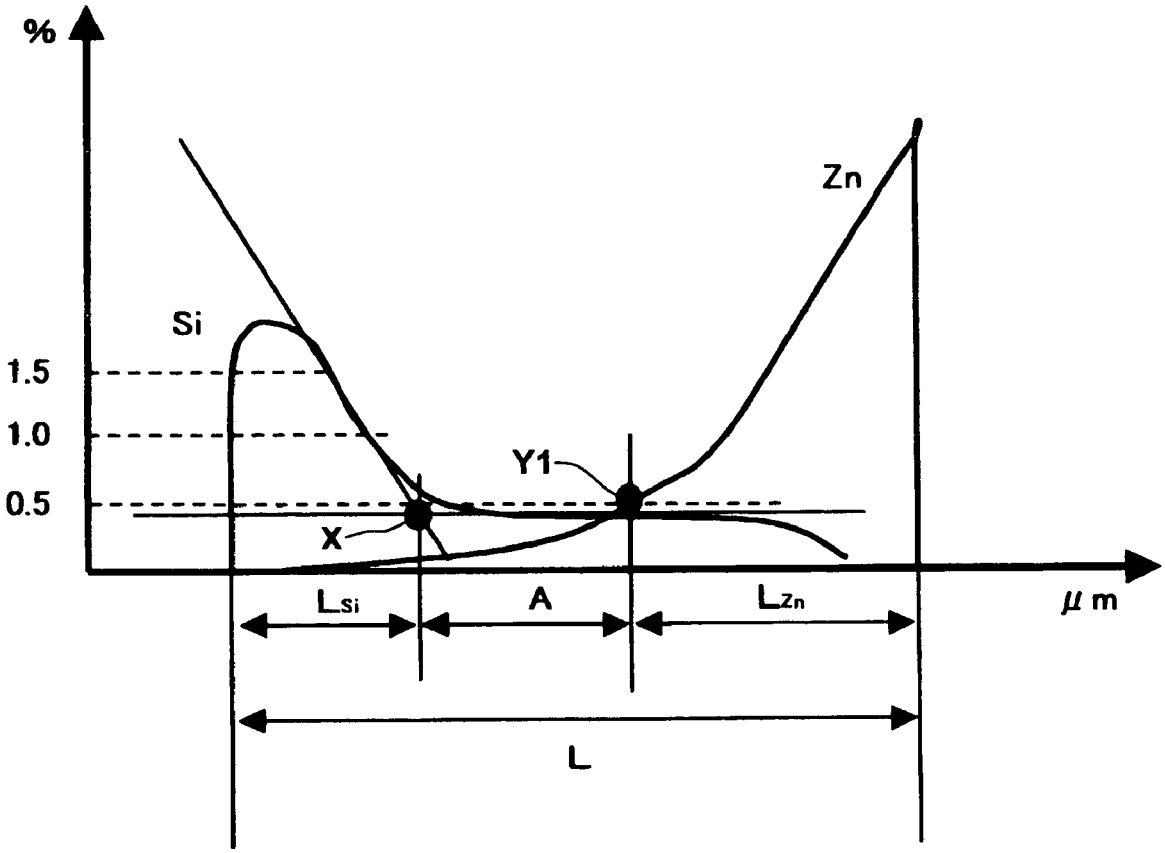
FIG. 1 schematically shows an example of an element diffusion profile by EPMA with respect to an aluminum alloy clad material, in which one face of an aluminum alloy core material having an Si content of 0.05 to 1.0% by mass is clad with an Al—Si-series filler material, and in which the other face of the core material is clad with a sacrificial material containing Zn.

According to the present invention, there is provided the following means:

(1) An aluminum alloy heat exchanger having a tube, wherein the tube is composed of a thin aluminum alloy clad material, in which one face of an aluminum alloy core material having an Si content of 0.05 to 1.0% by mass is clad with an Al—Si-series filler material containing 5 to 20% by mass of Si, and in which the other face of the core material is clad with a sacrificial material (which is preferably an aluminum alloy) containing at least one selected from the group consisting of 2 to 10% by mass of Zn and 1 to 5% by mass of Mg, and wherein an element diffusion profile of the aluminum alloy clad material after heating for brazing as determined by EPMA from a filler material side satisfies the following expression (1) when the sacrificial material contains Zn, and the following expression (2) when the sacrificial material contains Mg:

$$L-L_{Si}-L_{Zn} \geqq 40(\mu m) \quad (1)$$

wherein L represents a thickness (μm) of a wall of the tube;

$L_{Si}$ represents a position (μm) from a filler material surface of a cross point between an elongated line connecting a point corresponding to an Si content of 1.5% by mass and a point corresponding to an Si content of 1.0% by mass, and a line indicating the Si content of the core material, in the diffusion profile by EPMA from the filler material side; and $L_{Zn}$ represents a diffusion region (μm) from a sacrificial material surface, in which an amount of Zn diffused from the sacrificial material is 0.5% by mass or more;

$$L-L_{Si}-L_{Mg} \geqq 5(\mu m) \quad (2)$$

wherein L and $L_{Si}$ have the same meanings as those in the expression (1); and $L_{Mg}$ represents a diffusion region (μm) from a sacrificial material surface, in which an amount of Mg diffused from the sacrificial material is 0.05% by mass or more;

(2) The aluminum alloy heat exchanger according to item (1) above, wherein the sacrificial material contains 2 to 10% by mass of Zn, and wherein the element diffusion profile by EPMA satisfies the expression (1);

(3) The aluminum alloy heat exchanger according to item (1) above, wherein the sacrificial material contains 1 to 5% by mass of Mg, and wherein the element diffusion profile by EPMA satisfies the expression (2);

(4) The aluminum alloy heat exchanger according to item (1) above, wherein the sacrificial material contains 2 to 10% by mass of Zn and 1 to 5% by mass of Mg, and wherein the element diffusion profile by EPMA satisfies the expressions (1) and (2);

(5) A method of producing an aluminum alloy heat exchanger, comprising the step of:

brazing under heating, which comprises: being kept at a temperature of 600±5° C. for 3 to 4 minutes in a nitrogen atmosphere, and cooling at a cooling down rate from 550° C. to 200° C. of 50±5° C./min, wherein the aluminum alloy heat exchanger has a clad ratio of the filler material of 7% or more and less than 13%, and a clad ratio of the sacrificial material of 4% or more and less than 16.5%, within the range of clad material components described in item (1), (2), (3) or (4) above;

(6) A method of producing an aluminum alloy heat exchanger, comprising the step of:

brazing under rapid heating and cooling, which comprises: being kept at a target temperature of 600±5° C. for 3 to 4 minutes in a nitrogen atmosphere, in which a time for keeping at 400° C. or higher is less than 15 minutes, wherein the aluminum alloy heat exchanger has a clad ratio of the filler material of 7% or more and less than 20%, and a clad ratio of the sacrificial material of 4% or more and less than 30%, within the range of clad material components described in item (1), (2), (3) or (4) above;

(7) The method according to item (5) or (6) above, wherein a reduction ratio (rolled-down ratio) in a final cold-rolling step among a plurality of cold-rolling steps to which the aluminum alloy clad material is subjected, is 25% or less; and (8) The aluminum alloy heat exchanger according to item (1), (2), (3) or (4) above, wherein an average crystal grain diameter of recrystallized crystals of the core material of the aluminum alloy clad material after heating for brazing, is 180 μm or more.

The clad ratio as used herein refers to the proportion of the thickness of the cladding material (the filler material or sacrificial material) to the total thickness of the tube wall, and it is calculated by the equation of: (thickness of cladding material/thickness of tube wall)×100(%).

The term EPMA as used herein means an electron probe microanalyzer.

The present inventors have found that the external corrosion resistance of the tube having a limited tube wall thickness can be largely improved, by appropriately defining an area where the amount of diffusion of Si from the filler material, and the amount of diffusion of the sacrificial component Zn or Mg, are controlled to be equal to or less than prescribed levels, in the tube wall after heating for brazing. The present invention has been completed based on this finding.

The present invention will be described in detail hereinafter.

In the aluminum alloy heat exchanger of the present invention, the amounts of elements diffused into the core material after heating for brazing, and diffusion regions of the elements, are defined as described below.

Usually, Si diffuses from the filler material to the core material, and Zn or Mg diffuses from the sacrificial material to the core material, in the heat exchanger tube, under the heating condition for brazing (e.g. heating for brazing, which comprises: being kept at a temperature of 600±5° C. for 3 to 4 minutes in a nitrogen atmosphere; and cooling from 550° C. to 200° C., at a cooling down rate of 50±5° C./min) of producing the heat exchanger tube. The above heat exchanger tube is composed of a thin aluminum alloy clad material with a thickness of, for example, 0.23 mm or less, in which an aluminum alloy core material having an Si content of 0.05 to 0.8% by mass is clad with an Al—Si-series filler material containing 5 to 20% by mass of Si, on one face of the core material, with a clad ratio of 12% or more, and it is clad with a sacrificial material containing 2 to 10% by mass of Zn, or 1 to 5% by mass of Mg, on the other face of the core material, with a clad ratio of 16.5% or more.

The present inventors have found the following facts through intensive studies to evaluate the external corrosion resistance. That is, it was found that susceptibility to grain boundary corrosion of the core material at the filler material side tends to be enhanced as the amount of Si diffused from the filler material increases. It was also found that grain boundary corrosion, as pitting corrosion, starts from the center of the core material, when the amount of Zn diffused from the sacrificial material exceeds 0.5% by mass. Further, although Mg is added to the sacrificial material to enhance mechanical strength of the aluminum alloy in some cases, it was found that susceptibility to grain boundary corrosion is enhanced when the amount of Mg diffused from the sacrificial material exceeds 0.05% by mass.

Accordingly, it is assumed that a region where the amounts of diffused components as described above are controlled should be provided within a limited tube wall thickness, in order to suppress corrosion from advancing through the entire thickness of the tube wall.

Accordingly, in the present invention, the heat exchanger tube, after heating for brazing, is composed of a thin aluminum alloy clad material with a thickness of preferably 0.23 mm or less, and more preferably 0.225 mm or less, in which a core material composed of an aluminum alloy having an Si content of 0.05 to 1.0% by mass (preferably 0.05 to 0.8% by mass) is clad with an Al—Si-series filler material containing 5 to 20% by mass (preferably 8 to 12% by mass) of Si, on one face, with a clad ratio of 7% or more and less than 13% (preferably 7% or more and less than 12%, more preferably 7 to 11%), and with a sacrificial material (preferably composed of an aluminum alloy) containing 2 to 10% by mass (preferably 2 to 7% by mass) of Zn, and/or 1 to 5% by mass (preferably 1 to 2.5% by mass) of Mg, on the other face, with a clad ratio of 4% or more and less than 16.5% (preferably 8 to 16.2%). With respect to the heat exchanger tube above, the width between (X) a cross point between an elongated line of the line connecting the points indicating the Si content of 1.5% by mass, and 1.0% by mass, from the filler material side, and a line indicating the Si content of the core material, and (Y1) the position in the core material indicating the amount of Zn diffused from the sacrificial material of less than 0.5% by mass, or (Y2) the position in the core material indicating the amount of Mg diffused from the sacrificial material of less than 0.05% by mass, is defined to be 40 μm or more (preferable 45 μm or more and 200 μm or less) in the case between (X) and (Y1), or to be 5 μm or more (preferably 7 μm or more and 200 μm or less) in the case between (X) and (Y2), respectively, in the diffusion profile in the direction of thickness as determined by EPMA.

The widths are defined as described above, because it was found that the amount of diffused Si exceeding the Si content in the core material, and the content(s) of Zn and/or Mg which is a component(s) of the sacrificial material, should not evoke corrosion, and that corrosion may be suppressed from advancing through the entire thickness of the tube when the width of the restricted region is wider than a prescribed level.

In the diffusion profile as determined by EPMA after heating for brazing, the width between a cross point (X) between an elongated line of the line connecting the points indicating the Si content of 1.5% by mass and 1.0% by mass from the filler material side and a line indicating the Si content of the core material, and the position (Y1) in the core material indicating the amount of Zn diffused from the sacrificial material of less than 0.5% by mass, is defined to be 40 μm or more. This is because corrosion can be suppressed from advancing when the width is 40 μm or more, although corrosion cannot be suppressed from advancing when the width is less than 40 μm.

In the diffusion profile as determined by EPMA after heating for brazing, the width between a cross point (X) between an elongated line of the line connecting the points indicating the Si content of 1.5% by mass and 1.0% by mass from the filler material side and a line indicating the Si content of the core material, and the position (Y2) in the core material indicating the amount of Mg diffused from the sacrificial material of less than 0.05% by mass, is defined to be 5 μm or more. This is because corrosion at the grain boundary can be suppressed when the width is 5 μm or more, although corrosion at the grain boundary cannot be suppressed from advancing when the width is less than 5 μm.

It may be assumed that the heat exchanger having a tube in which the above amount(s) of diffusion is suppressed, may be produced, by providing in the core material a region having an amount of each diffused element of less than the amount as described above, by merely increasing the thickness of the aluminum alloy clad material (an aluminum brazing sheet). However, the thickness of the aluminum alloy brazing sheet is formed to be thin without particularly increasing the thickness in the present invention, and the thickness is generally 0.24 mm or less, preferably 0.23 mm or less. Consequently, the thickness of the tube core material, in which both the amount of diffusion of the filler material Si, and the diffusion region of the sacrificial material Zn and/or Mg are controlled, is relatively increased, within the prescribed thickness of the above clad material (brazing sheet).

Elements such as Cu and Zn may be contained, if necessary, in the filler material, within the range not impairing the effect of the present invention. Elements such as Fe, Si, Mn and Ti may be contained, if necessary, in the sacrificial material, within the range not impairing the effect of the present invention. Further, elements such as Fe, Mn, Cu and Ti may be contained, if necessary, in the core material, within the range not impairing the effect of the present invention.

The method of producing the heat exchanger having a tube excellent in the corrosion resistance will be described hereinafter.

Using the aluminum alloy clad material as described above, the heat exchanger is produced by heating for brazing the aluminum alloy clad material, under a usual heating condition for brazing when producing a heat exchanger tube. As the heating condition for brazing, the clad material is preferably subjected to heating for brazing, which comprises: cooling from 550° C. to 200° C. at a cooling down rate of 50±5° C./min, after being kept at a temperature of 600±5° C. for 3 to 4 minutes in a nitrogen atmosphere. The clad material is also preferably subjected to a rapid heating and cooling for brazing, in which the period of time for being kept at 400° C. or more is less than 15 minutes when the clad material is kept at a target temperate of 600±5° C. for 3 to 4 minutes in a nitrogen atmosphere. In particular, the period of time for being kept at 400° C. or higher is preferably 10 to 14 minutes, in the rapid heating and cooling brazing.

The clad ratios of the filler material and sacrificial material vary, depending on the heating conditions for brazing.

As described above, the width between a cross point (X) between an elongated line of the line connecting the points indicating the Si content of 1.5% by mass and 1.0% by mass from the filler material side, and a line indicating the Si content of the core material, and the position (Y1) in the core material indicating the amount of Zn diffused from the sacrificial material of less than 0.5% by mass, or the position (Y2) in the core material indicating the mount of Mg diffused from the sacrificial material of less than 0.05% by mass, is defined to be 40 μm or more (between (X) and (Y1)), or to be 5 μm or more (between (X) and (Y2)), respectively, in the diffusion profile by EPMA after heating for brazing within the range of the clad material components. The inventors of the present invention have found the clad ratios of the filler material, by which a region having the above width of 40 μm or more or alternatively 5 μm or more, can be ensured with a certain extent or more of thickness, and by which bonding of the heat exchanger by brazing is enabled without impairing the brazing property. The inventors have also found the clad ratios of the sacrificial material that sufficiently satisfies internal corrosion resistance. These clad ratios will be described below.

The clad ratio of the filler material is generally 7% or more and less than 13%, and the clad ratio of the sacrificial material is generally 4% or more and less than 16.5%, within the ranges of the tube wall thickness and the clad material components, when the tube is subjected to the brazing under heating, which comprise: cooling at a cooling-down rate of 50±5° C./min from 550° C. to 200° C., after being kept at a temperature of 600±5° C. for 3 to 4 minutes in a nitrogen atmosphere. Preferably, the clad ratio of the filler material is 7% or more and less than 12% (more preferably 7 to 11%), and the clad ratio of the sacrificial material is preferably 8 to 16.2%.

According to the above clad ratios, the region (width) between a cross point (X) between an elongated line of the line connecting the points indicating the Si content of 1.5% by mass and 1.0% by mass from the filler material side, and a line indicating the Si content of the core material, and the position (Y1) or (Y2) in the core material indicating the amount of diffused Zn of less than 0.5% by mass, or the amount of diffused Mg of less than 0.05% by mass, each from the sacrificial material, can preferably be provided to be 40 μm or more, or alternatively 5 μm or more, respectively, in the diffusion profile by EPMA after heating for brazing. This means that the external corrosion resistance of a heat exchanger having the tube excellent in corrosion resistance can be sufficiently improved, while enabling the production of the filler material capable of sufficient brazing of the heat exchanger without impairing the brazing ability, as well as the production of the heat exchanger having the tube that sufficiently satisfies the internal corrosion resistance.

On the other hand, the clad ratio of the filler material is generally 7% or more and less than 20%, and the clad ratio of the sacrificial material is generally 4% or more and less than 30%, within the ranges of the tube wall thickness and the clad material components, when the tube is subjected to the brazing under rapid heating and cooling, in which the period of time for being kept at 400° C. or higher is less than 15 minutes, during being kept at a target maximum temperate of 600±5° C. for 3 to 4 minutes in a nitrogen atmosphere. Preferably, the clad ratio of the filler material is 7 to 16%, and the clad ratio of the sacrificial material is 8 to 25%.

According to the clad ratios above, the width between a cross point (X) between an elongated line of the line connecting the points indicating the Si content of 1.5% by mass and 1.0% by mass from the filler material side, and a line indicating the Si content of the core material, and the position (Y1) or (Y2) in the core material indicating the amount of diffused Zn of less than 0.5% by mass, or the amount of diffused Mg of less than 0.05% by mass, each from the sacrificial material, can preferably be provided to be 40 μm or more, or alternatively 5 μm or more, respectively, in the diffusion profile by EPMA after heating for brazing. This means that the external corrosion resistance of a heat exchanger having the tube excellent in corrosion resistance can be sufficiently improved, while enabling the production of the filler material capable of sufficient brazing of the heat exchanger without impairing the brazing ability, as well as the production of the heat exchanger having the tube that sufficiently satisfies the internal corrosion resistance.

The average crystal grain diameter of recrystallized crystals after heating for brazing can be made giant to 180 μm or more, by adjusting the final cold-rolling ratio (reduction ratio in the cold-rolling step finally conducted among a plurality of cold-rolling steps, if any) of the above aluminum alloy clad material to 25% or less (generally, 15% or more), when the clad material is subjected to brazing under heating, which comprises: cooling from 550° C. to 200° C. at a cooling-down rate of 50±5° C./min, after being kept at a temperature of 600±5° C. for 3 to 4 minutes in a nitrogen atmosphere, or alternatively when the clad material is subjected to brazing under rapid heating and cooling, which comprises: being kept at a target maximum temperature of 600±5° C. for 3 to 4 minutes in a nitrogen atmosphere, in which a period of time at 400° C. or higher is less than 15 minutes. The aluminum alloy clad material to be used in the present invention can be produced, for example, by a usual cold-rolling method for a cladding method. It may be difficult to control the crystal grain diameter of the recrystallized crystals in the core material to be 180 μm or more, after the heat treatment for brazing or after the brazing under rapid heating and cooling, when the final cold-rolling ratio of the aluminum alloy clad material is too large. This may bring it difficult that grain boundary corrosion can be sufficiently suppressed from advancing in the direction of thickness of the tube wall. Accordingly, it is made difficult to sufficiently improve external corrosion resistance of a heat exchanger having a tube excellent in corrosion resistance, while making it difficult to produce a filler material capable of brazing of a heat exchanger without impairing brazing ability, and to produce a heat exchanger having a tube that sufficiently satisfies internal corrosion resistance. More preferably, the final cold-rolling ratio of the aluminum alloy clad material is 22% or less.

The average crystal grain diameter of the recrystallized crystals in the core material is preferably 180 μm or more, after the above-mentioned heating for brazing. It is difficult to sufficiently suppress grain boundary corrosion from advancing in the direction of thickness of the tube wall, when the average crystal grain diameter of the recrystallized crystals is too small. The average crystal grain diameter of the recrystallized crystals in the core material is more preferably 190 μm or more and 400 μm or less.

The average crystal grain diameter can be measured, for example, by a usual slice method using an optical microscopic photograph with a magnification of 200.

Figure 3:
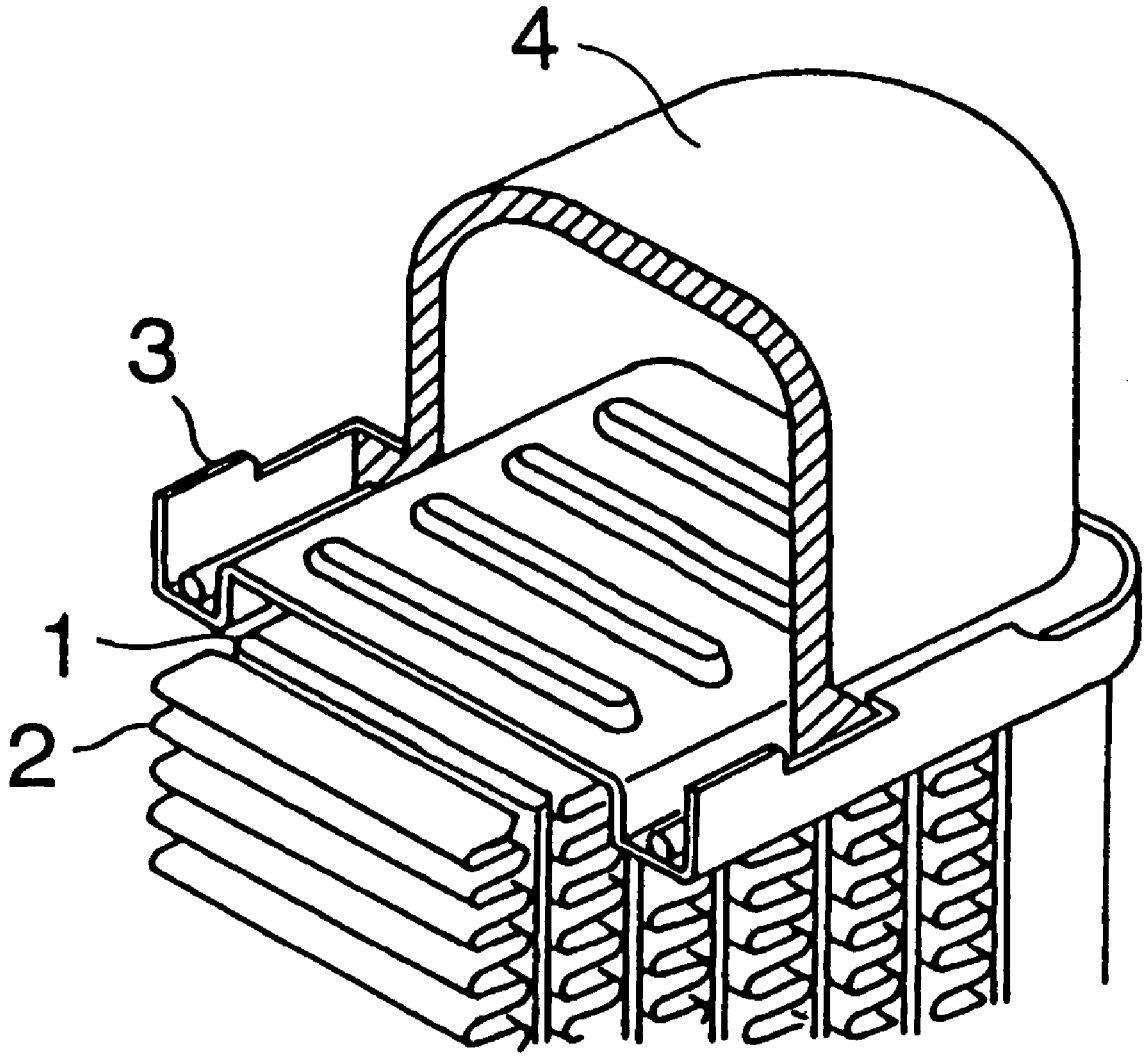
FIG. 3 is a schematic view showing an example of the aluminum alloy heat exchanger of the present invention.

As the aluminum alloy heat exchanger (i.e. a radiator) of the present invention, structure thereof and the like is not particularly limited, and the heat exchanger may have any of various structures, as long as the heat exchanger has a tube composed of the prescribed aluminum alloy clad material, and an element diffusion profile of the aluminum alloy clad material after heating for brazing as determined by EPMA from a filler material side satisfies the conditions defined by the expressions (1) and/or (2). An example of the aluminum alloy heat exchanger of the present invention, for example, includes one shown in FIG. 3. The heat exchanger shown in FIG. 3, has thin wall fins (2) machined in a corrugated form among plural flattened tubes (1) integrally built. Both ends of the flattened tubes (1) are opened respectively to a space formed by a header (3) and a tank (4), so that a high temperature refrigerant is transmitted from a space of the tank on one side through the flattened tubes (1) to a space of the tank (4) on the other side, thereby effecting heat exchange in a portion of the tubes (1) and the fins (2) and again circulating the resultant low temperature refrigerant.

The aluminum alloy heat exchanger of the present invention is preferable for use in, for example, an automobile radiator. In particular, the aluminum alloy heat exchanger of the present invention is a heat exchanger having a tube for flowing a refrigerant, which heat exchanger is excellent in corrosion resistance by enhancing external corrosion resistance at the filler material side, to make the heat exchanger to have a long service life.

According to the present invention, can be provided an aluminum alloy heat exchanger having an extremely improved resistance to external corrosion of a tube within a limited thickness of the tube wall, by properly defining the region where the diffusion amount of Si from the filler material and the diffusion amount of the sacrificial material component(s) Zn and/or Mg are controlled to be a prescribed level or lower, in the tube wall after heating for brazing. That is, corrosion from the outside (atmosphere side) is suppressed from advancing to cause through hole into the direction of thickness of the tube wall in the heat exchanger having a thinned tube, and the service life of the heat exchanger against corrosion thereof can be markedly prolonged, as compared to a conventional heat exchanger. In particular, a sufficient external corrosion resistance can be exhibited, in a heat exchanger having a thinned tube wall, even under a severe corrosive environment where a corrosion accelerating liquid, such as one containing an antifreezing agent, touches onto the tube.

When the clad material is subjected to the heating treatment for brazing, which includes: cooling from 550° C. to 200° C. at a cooling-down rate of 50±5° C./min, after being kept at a temperature of 600±5° C. for 3 to 4 minutes in a nitrogen atmosphere, or when the clad material is subjected to a rapid heating and cooling brazing, in which the total time for being kept at 400° C. or more is less than 15 minutes when the clad material is kept at a target temperate of 600±5° C. for 3 to 4 minutes in a nitrogen atmosphere, the average crystal grain diameter of the recrystallized crystals in the core material after heating for brazing can be adjusted to 180 μm or more, by controlling the final cold-rolling ratio of the aluminum alloy clad material to 25% or less. Further, grain boundary corrosion can be sufficiently suppressed from advancing in the direction of thickness of the tube wall, by controlling the average crystal grain diameter of the recrystallized crystals of the core material of the aluminum alloy clad material after heating for brazing, to be 180 μm or more.

The present invention will be described in more detail based on examples given below, but the invention is not meant to be limited by these examples.

EXAMPLES

Example 1

Brazing sheets having a total thickness of 0.225 mm and clad with the clad ratios, as shown in Table 2, were produced, using the alloy Nos. 1 to 21 having the compositions as shown in Table 1. These brazing sheets were subjected to the heat treatment for brazing, which included: cooling from 550 to 200° C. at a cooling-down rate of 50±5° C./min, after being kept at a target temperature of 600±5° C. for 3 to 4 minutes in a nitrogen atmosphere. Then, element diffusion profiles were measured using EPMA. Examples of the profiles are shown in FIGS. 1 and 2.

FIG. 1 is a graph schematically showing an example of the element diffusion profile by EPMA with respect to the brazing sheet, in which the aluminum alloy core material having an Si content of 0.05 to 1.0% by mass was clad with the Al—Si-series filler material on one face, and clad with the sacrificial material containing Zn on the other face. The vertical axis represents the contents (% by mass) of elements, and the horizontal axis represents the thickness (μm). L represents the thickness of the tube wall.

Figure 2:
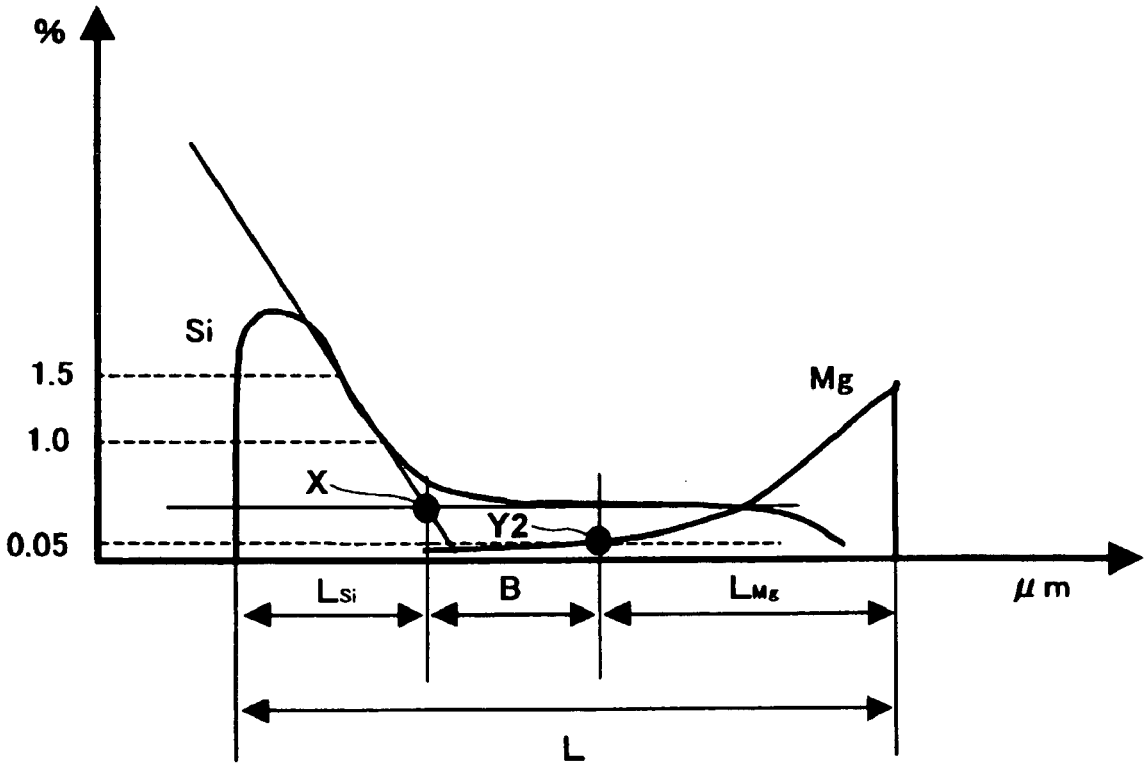
FIG. 2 schematically shows an example of an element diffusion profile by EPMA with respect to an aluminum alloy clad material, in which one face of an aluminum alloy core material having an Si content of 0.05 to 1.0% by mass is clad with an Al—Si-series filler material, and in which the other face of the core material is clad with a sacrificial material containing Mg.

Further, FIG. 2 is a graph schematically showing an example of the element diffusion profile by EPMA with respect to the brazing sheet, in which the aluminum alloy core material having an Si content of 0.05 to 1.0% by mass was clad with the Al—Si-series filler material on one face, and clad with the sacrificial material containing Mg on the other face. The vertical axis represents the contents (% by mass) of elements, and the horizontal axis. represents the thickness (μm). L represents the thickness of the tube wall.

The width (width A in FIG. 1) between the cross point (X) of the elongated line of the line connecting between the points with the filler material Si content of 1.5% by mass and 1.0% by mass, and the line indicating the core material Si content, and the point (Y1) indicating the sacrificial material Zn content of 0.5% by mass, was measured for each sample of the brazing sheets, as shown in FIG. 1. The results are shown in Table 3.

The width (width B in FIG. 2) between the cross point (X) of the elongated line of the line connecting between the points with the filler material Si content of 1.5% by mass and 1.0% by mass, and the line indicating the core material Si content, and the point (Y2) indicating the sacrificial material Mg content of 0.05% by mass if Mg was present as a sacrificial material alloying element, was measured for each sample of the brazing sheets, as shown in FIG. 2. The results are shown in Table 3.

To evaluate the external corrosion resistance of each sample, an electric current with a current density of 1 mA/cm$^2$ was continued to flow for 24 hours, to carry out a constant current electrolysis test, while exposing the filler material layer side to a 5% by mass NaCl solution. Then, the cross section of the resultant sample was observed using an optical microscope at a magnification of 200. The results are shown in the column of corrosion test results in Table 3. In Table 3, the sample, in which no through hole or pitting corrosion or grain boundary corrosion was observed at all in an arbitrary cross-section of the sample in a 10-mm range of the sheet width subjected to the constant current electrolysis test, was evaluated as good, which is designated by "◎". Further, the sample, in which quite shallow through hole or quite slight grain boundary corrosion was observed in an arbitrary cross-section of the sample in a 10-mm range of the sheet width subjected to the constant current electrolysis test, is designed by "○". On the other hand, the sample, in which even one through hole pitting corrosion or grain boundary corrosion was observed in an arbitrary cross-section of the sample in a 10-mm range of the sheet width subjected to the constant current electrolysis test, is designated by "x".

TABLE 2

| Alloy No. | Clad ratio (%) Filler material | Sacrificial material | Remarks |
|---|---|---|---|
| 1 | 10 | 13.3 | This invention |
| 2 | 8.9 | 16.2 | This invention |
| 3 | 9.8 | 15.2 | This invention |
| 4 | 7.1 | 8.9 | This invention |
| 5 | 7.5 | 13.6 | This invention |
| 6 | 7 | 14 | This invention |
| 7 | 10 | 14.0 | This invention |
| 8 | 9 | 16.0 | This invention |
| 9 | 10 | 15.0 | This invention |
| 10 | 10 | 15.0 | This invention |
| 11 | 7 | 9.0 | This invention |
| 12 | 12 | 16.1 | This invention |
| 13 | 12 | 16.3 | This invention |
| 14 | 14 | 18.5 | Conventional example |
| 15 | 14 | 19.0 | Conventional example |
| 16 | 14 | 18.5 | Comparative example |
| 17 | 11.7 | 18.5 | Comparative example |
| 18 | 12 | 14 | Comparative example |
| 19 | 12 | 18 | Comparative example |
| 20 | 14 | 18 | Comparative example |
| 21 | 14 | 18.5 | Comparative example |

TABLE 1

| Alloy | Alloy composition (mass %) Filler material | | Core material | | | | | Sacrificial material | | | |
|---|---|---|---|---|---|---|---|---|---|---|---|
| No. | Si | Al | Si | Fe | Mn | Cu | Al | Zn | Mg | Al | Remarks |
| 1 | 8 | Balance | 0.4 | 0.15 | 1.2 | 0.75 | Balance | 6 | 3.0 | Balance | This invention |
| 2 | 9 | Balance | 0.5 | 0.15 | 1.6 | 0.50 | Balance | 4 | 2.2 | Balance | This invention |
| 3 | 10 | Balance | 0.3 | 0.15 | 1.2 | 0.75 | Balance | 5 | 1.0 | Balance | This invention |
| 4 | 12 | Balance | 0.7 | 0.15 | 1.2 | 0.75 | Balance | 7 | 4.7 | Balance | This invention |
| 5 | 12 | Balance | 0.75 | 0.15 | 1.6 | 0.50 | Balance | 3 | 3.3 | Balance | This invention |
| 6 | 12 | Balance | 0.9 | 0.15 | 1.6 | 0.90 | Balance | 3 | 3.0 | Balance | This invention |
| 7 | 8 | Balance | 0.4 | 0.15 | 1.2 | 0.75 | Balance | 6 | — | Balance | This invention |
| 8 | 9 | Balance | 0.5 | 0.15 | 1.6 | 0.50 | Balance | 4 | — | Balance | This invention |
| 9 | 10 | Balance | 0.3 | 0.15 | 1.2 | 0.75 | Balance | 5 | — | Balance | This invention |
| 10 | 10 | Balance | 0.9 | 0.15 | 1.6 | 0.90 | Balance | 5 | — | Balance | This invention |
| 11 | 12 | Balance | 0.7 | 0.15 | 1.2 | 0.75 | Balance | 7 | — | Balance | This invention |
| 12 | 12 | Balance | 0.75 | 0.15 | 1.6 | 0.50 | Balance | — | 2.5 | Balance | This invention |
| 13 | 12 | Balance | 0.9 | 0.15 | 1.6 | 0.95 | Balance | — | 2.8 | Balance | This invention |
| 14 | 10 | Balance | 0.3 | 0.15 | 1.2 | 0.75 | Balance | 3.5 | 2.2 | Balance | Conventional example |
| 15 | 10 | Balance | 0.3 | 0.15 | 1.2 | 0.75 | Balance | 3.5 | — | Balance | Conventional example |
| 16 | 22 | Balance | 0.3 | 0.15 | 1.2 | 0.50 | Balance | 3.5 | 6.0 | Balance | Comparative example |
| 17 | 10 | Balance | 1.2 | 0.15 | 1.2 | 0.75 | Balance | 3.5 | 2.2 | Balance | Comparative example |
| 18 | 10 | Balance | 0.4 | 0.15 | 1.2 | 0.75 | Balance | 12 | — | Balance | Comparative example |
| 19 | 10 | Balance | 0.4 | 0.15 | 1.2 | 0.75 | Balance | — | 6.0 | Balance | Comparative example |
| 20 | 10 | Balance | — | — | — | — | Balance | 3.5 | 2.5 | Balance | Comparative example |
| 21 | 10 | Balance | — | — | — | — | Balance | 3.5 | — | Balance | Comparative example |

TABLE 3

| Alloy No. | Width A in FIG. 1 (μm) | Width B in FIG. 2 (μm) | Corrosion test results (Constant current electrolysis test, 24 h) Pitting corrosion *1 | Grain boundary corrosion *2 | Remarks |
|---|---|---|---|---|---|
| 1 | 40 | 5 | ◎ | ○ | This invention |
| 2 | 50 | 10 | ◎ | ○ | This invention |
| 3 | 45 | 7 | ◎ | ○ | This invention |
| 4 | 45 | 7 | ◎ | ○ | This invention |
| 5 | 50 | 5 | ◎ | ○ | This invention |
| 6 | 45 | 5 | ◎ | ○ | This invention |
| 7 | 40 | — | ◎ | ◎ | This invention |
| 8 | 50 | — | ◎ | ◎ | This invention |
| 9 | 45 | — | ◎ | ◎ | This invention |
| 10 | 43 | — | ◎ | ◎ | This invention |
| 11 | 45 | — | ◎ | ◎ | This invention |
| 12 | — | 6 | ◎ | ◎ | This invention |
| 13 | — | 5 | ◎ | ◎ | This invention |
| 14 | 28 | 0 | X | X | Conventional example |
| 15 | 28 | — | X | X | Conventional example |
| 16 | 32 | 0 | X | X | Comparative example |
| 17 | 30 | 0 | X | X | Comparative example |
| 18 | 30 | — | X | X | Comparative example |
| 19 | — | 0 | X | X | Comparative example |
| 20 | 30 | 0 | X | X | Comparative example |
| 21 | 30 | — | X | X | Comparative example |

(Note)
*1 ◎: No pitting corrosion was observed at all; ○: Quite shallow pitting corrosion was observed; X: Through hole pitting corrosion was observed.
*2 ◎: No grain boundary corrosion was observed at all; ○: Quite slight grain boundary corrosion was observed; X: Grain boundary corrosion was observed.

From the results shown in Table 3, it can be understood that corrosion advanced through the entire tube thickness in the conventional example and the comparative example, but corrosion was limited in the filler material layer in the tube sheet that can be used in the aluminum alloy heat exchanger of the present invention, showing good external corrosion resistance.

Example 2

Brazing sheets with a total thickness of 0.225 mm and clad with the clad ratios, as shown in Table 5, were produced, using the alloy Nos. 22 to 42 having the compositions as shown in Table 4. These brazing sheets were subjected to the rapid heating and cooling brazing, in which the total time for being kept at 400° C. or higher was less than 15 minutes, when the brazing sheets were kept at a target temperature of 600±5° C. for 3 to 4 minutes in a nitrogen atmosphere. Then, element diffusion profiles were measured using EPMA, in the same manner as in Example 1. Examples of the profile are shown in FIGS. 1 and 2, similarly in Example 1.

The width (width A in FIG. 1) between the cross point (X) of the elongated line of the line connecting between the points with the filler material Si content of 1.5% by mass and 1.0% by mass, and the line indicating the core material Si content, and the point (Y1) indicating the sacrificial material Zn content of 0.5% by mass, was measured for each sample of the brazing sheets, as shown in FIG. 1. The results are shown in Table 6.

The width (width B in FIG. 2) between the cross point (X) of the elongated line of the line connecting between the points with the filler material Si content of 1.5% by mass and 1.0% by mass, and the line indicating the core material Si content, and the point (Y2) indicating the sacrificial material Mg content of 0.05% by mass if Mg was present as a sacrificial material alloying element, was measured for each sample of the brazing sheets, as shown in FIG. 2. The results are shown in Table 6.

To evaluate the external corrosion resistance of each sample, an electric current with a current density of 1 mA/cm$^2$ was continued to flow for 24 hours, to carry out a constant current electrolysis test, while exposing the filler material layer side to a 5% by mass NaCl solution. Then, the cross section of the resultant sample was observed in the same manner as in Example 1. The results are shown in the column of corrosion test results in Table 6. The marks represented in Table 6 have the same meanings as in Table 3.

TABLE 4

| Alloy No. | Alloy composition (mass %) Filler material Si | Al | Core material Si | Fe | Mn | Cu | Al | Sacrificial material Zn | Mg | Al | Remarks |
|---|---|---|---|---|---|---|---|---|---|---|---|
| 22 | 8 | Balance | 0.4 | 0.15 | 1.2 | 0.75 | Balance | 6 | 3.0 | Balance | This invention |
| 23 | 9 | Balance | 0.5 | 0.15 | 1.6 | 0.50 | Balance | 4 | 2.2 | Balance | This invention |
| 24 | 10 | Balance | 0.3 | 0.15 | 1.2 | 0.75 | Balance | 5 | 1.0 | Balance | This invention |
| 25 | 12 | Balance | 0.7 | 0.15 | 1.2 | 0.75 | Balance | 7 | 4.7 | Balance | This invention |
| 26 | 12 | Balance | 0.75 | 0.15 | 1.6 | 0.50 | Balance | 3 | 3.3 | Balance | This invention |
| 27 | 12 | Balance | 0.75 | 0.15 | 1.6 | 0.50 | Balance | 3 | 3.0 | Balance | This invention |
| 28 | 8 | Balance | 0.4 | 0.15 | 1.2 | 0.75 | Balance | 6 | — | Balance | This invention |
| 29 | 9 | Balance | 0.5 | 0.15 | 1.6 | 0.50 | Balance | 4 | — | Balance | This invention |
| 30 | 10 | Balance | 0.3 | 0.15 | 1.2 | 0.75 | Balance | 5 | — | Balance | This invention |
| 31 | 10 | Balance | 0.9 | 0.15 | 1.6 | 0.90 | Balance | 5 | — | Balance | This invention |
| 32 | 12 | Balance | 0.7 | 0.15 | 1.2 | 0.75 | Balance | 7 | — | Balance | This invention |
| 33 | 12 | Balance | 0.75 | 0.15 | 1.6 | 0.50 | Balance | — | 2.5 | Balance | This invention |
| 34 | 12 | Balance | 0.9 | 0.15 | 1.6 | 0.95 | Balance | — | 2.8 | Balance | This invention |
| 35 | 10 | Balance | 0.3 | 0.15 | 1.2 | 0.75 | Balance | 3.5 | 2.2 | Balance | Conventional example |

TABLE 4-continued

| Alloy | Alloy composition (mass %) | | | | | | | | | | |
|---|---|---|---|---|---|---|---|---|---|---|---|
| | Filler material | | Core material | | | | | Sacrificial material | | | |
| No. | Si | Al | Si | Fe | Mn | Cu | Al | Zn | Mg | Al | Remarks |
| 36 | 10 | Balance | 0.3 | 0.15 | 1.2 | 0.75 | Balance | 3.5 | — | Balance | Conventional example |
| 37 | 22 | Balance | 0.3 | 0.15 | 1.2 | 0.50 | Balance | 3.5 | 6.0 | Balance | Comparative example |
| 38 | 10 | Balance | 1.2 | 0.15 | 1.2 | 0.75 | Balance | 3.5 | 2.2 | Balance | Comparative example |
| 39 | 10 | Balance | 0.4 | 0.15 | 1.2 | 0.75 | Balance | 12 | — | Balance | Comparative example |
| 40 | 10 | Balance | 0.4 | 0.15 | 1.2 | 0.75 | Balance | — | 6.0 | Balance | Comparative example |
| 41 | 10 | Balance | — | — | — | — | Balance | 3.5 | 2.5 | Balance | Comparative example |
| 42 | 10 | Balance | — | — | — | — | Balance | 3.5 | — | Balance | Comparative example |

TABLE 5

| Alloy No. | Clad ratio (%) | | Remarks |
|---|---|---|---|
| | Filler material | Sacrificial material | |
| 22 | 16 | 25 | This invention |
| 23 | 18 | 28 | This invention |
| 24 | 15 | 22 | This invention |
| 25 | 19 | 21 | This invention |
| 26 | 17 | 27 | This invention |
| 27 | 16 | 25 | This invention |
| 28 | 16 | 25 | This invention |
| 29 | 18 | 28 | This invention |
| 30 | 15 | 22 | This invention |
| 31 | 14 | 21 | This invention |
| 32 | 19 | 21 | This invention |
| 33 | 17 | 27 | This invention |
| 34 | 16 | 26 | This invention |
| 35 | 23 | 33 | Conventional example |
| 36 | 23 | 33 | Conventional example |
| 37 | 21 | 28 | Comparative example |
| 38 | 18 | 28 | Comparative example |
| 39 | 19 | 28 | Comparative example |
| 40 | 19 | 31 | Comparative example |
| 41 | 21 | 31 | Comparative example |
| 42 | 21 | 31 | Comparative example |

TABLE 6

| Alloy No. | Width A in FIG. 1 (μm) | Width B in FIG. 2 (μm) | Corrosion test results (Constant current electrolysis test, 24 h) | | Remarks |
|---|---|---|---|---|---|
| | | | Pitting corrosion *1 | Grain boundary corrosion *2 | |
| 22 | 45 | 7 | ◎ | ○ | This invention |
| 23 | 45 | 8 | ◎ | ○ | This invention |
| 24 | 50 | 10 | ◎ | ○ | This invention |
| 25 | 50 | 10 | ◎ | ○ | This invention |
| 26 | 45 | 8 | ◎ | ○ | This invention |
| 27 | 43 | 6 | ◎ | ○ | This invention |
| 28 | 45 | — | ◎ | ◎ | This invention |
| 29 | 45 | — | ◎ | ◎ | This invention |
| 30 | 50 | — | ◎ | ◎ | This invention |
| 31 | 48 | — | ◎ | ◎ | This invention |
| 32 | 50 | — | ◎ | ◎ | This invention |
| 33 | — | 8 | ◎ | ◎ | This invention |

TABLE 6-continued

| Alloy No. | Width A in FIG. 1 (μm) | Width B in FIG. 2 (μm) | Corrosion test results (Constant current electrolysis test, 24 h) | | Remarks |
|---|---|---|---|---|---|
| | | | Pitting corrosion *1 | Grain boundary corrosion *2 | |
| 34 | — | 7 | ◎ | ◎ | This invention |
| 35 | 25 | 3 | X | X | Conventional example |
| 36 | 25 | — | X | X | Conventional example |
| 37 | 33 | 0 | X | X | Comparative example |
| 38 | 30 | 3 | X | X | Comparative example |
| 39 | 28 | — | X | X | Comparative example |
| 40 | — | 0 | X | X | Comparative example |
| 41 | 35 | 3 | X | X | Comparative example |
| 42 | 35 | — | X | X | Comparative example |

(Note)
*1 ◎: No pitting corrosion was observed at all; ○: Quite shallow pitting corrosion was observed; X: Through hole pitting corrosion was observed.
*2 ◎: No grain boundary corrosion was observed at all; ○: Quite slight grain boundary corrosion was observed; X: Grain boundary corrosion was observed.

From the results shown in Table 6, it can be understood that corrosion advanced through the entire tube thickness in the conventional example and the comparative example, but corrosion was limited in the outer half or around of the thickness in the tube sheet that can be used in the aluminum alloy heat exchanger of the present invention, showing good external corrosion resistance.

Example 3

Brazing sheets having a total thickness of 0.225 mm and clad with the clad ratios, as shown in Table 8, were produced, using the alloy Nos. 43 to 59 having the compositions as shown in Table 7. In the production process, the final cold-rolling ratio was set to 18 to 45%. The brazing sheets using the alloy No. 43, 44, 47, 48, 51, 53, 57 or 58 were subjected to the brazing heat treatment, which included: cooling from 550° C. to 200° C. at a cooling-down rate of 50±5° C./min, after being kept at a target temperature of 600±5° C. for 3 to 4 minutes in a nitrogen atmosphere. The brazing sheets using the alloy No. 45, 46, 49, 50, 52, 54, 55, 56 or 59 were subjected to the rapid heating and cooling brazing, in which the brazing sheets were kept at a target temperature of 600±5° C. for 3 to 4 minutes in a nitrogen atmosphere so that the total period of time for being kept at 400° C. or higher would be less than 15 minutes. Then, the surface texture of the rolled face was observed with an optical microscope with a magnification in the range of 100 to 200, and the average crystal grain diameter of the recrystallized crystals in the core material was measured. Further, element diffusion profiles were measured using EPMA, in the same manner as in Example 1. The results are shown in Table 8.

To evaluate the external corrosion resistance of each brazing sheet sample, an electric current with a current density of 1 mA/cm$^2$ was continued to flow for 24 hours, to carry out a constant current electrolysis test, while exposing the filler material layer side to a 5% by mass NaCl solution. Then, the cross section of the resultant sample was observed in the same manner as in Example 1. The results are shown in Table 8. In Table 8, the marks "◎", "○" and "x" have the same meanings as those in Table 3.

TABLE 7

| Alloy | Alloy composition (mass %) | | | | | | | | | | |
|---|---|---|---|---|---|---|---|---|---|---|---|
| | Filler material | | Core material | | | | | Sacrificial material | | | |
| No. | Si | Al | Si | Fe | Mn | Cu | Al | Zn | Mg | Al | Remarks |
| 43 | 8 | Balance | 0.4 | 0.15 | 1.2 | 0.75 | Balance | 6 | 3.0 | Balance | This invention |
| 44 | 9 | Balance | 0.5 | 0.15 | 1.6 | 0.50 | Balance | 4 | 2.2 | Balance | This invention |
| 45 | 10 | Balance | 0.3 | 0.15 | 1.2 | 0.75 | Balance | 5 | 1.0 | Balance | This invention |
| 46 | 10 | Balance | 0.9 | 0.15 | 1.6 | 0.90 | Balance | 3 | 3.0 | Balance | This invention |
| 47 | 8 | Balance | 0.4 | 0.15 | 1.2 | 0.75 | Balance | 6 | — | Balance | This invention |
| 48 | 9 | Balance | 0.5 | 0.15 | 1.6 | 0.50 | Balance | 4 | — | Balance | This invention |
| 49 | 10 | Balance | 0.3 | 0.15 | 1.2 | 0.75 | Balance | 5 | — | Balance | This invention |
| 50 | 10 | Balance | 0.9 | 0.15 | 1.6 | 0.90 | Balance | 5 | — | Balance | This invention |
| 51 | 9 | Balance | 0.5 | 0.15 | 1.6 | 0.50 | Balance | — | 2.2 | Balance | This invention |
| 52 | 9 | Balance | 0.9 | 0.15 | 1.6 | 0.95 | Balance | — | 2.5 | Balance | This invention |
| 53 | 9 | Balance | 0.5 | 0.15 | 1.6 | 0.50 | Balance | 4 | 2.2 | Balance | This invention |
| 54 | 9 | Balance | 0.5 | 0.15 | 1.6 | 0.50 | Balance | 4 | — | Balance | This invention |
| 55 | 10 | Balance | 0.3 | 0.15 | 1.2 | 0.75 | Balance | 5 | 1.0 | Balance | This invention |
| 56 | 10 | Balance | 0.3 | 0.15 | 1.2 | 0.75 | Balance | 3.5 | 2.2 | Balance | Conventional example |
| 57 | 10 | Balance | 0.3 | 0.15 | 1.2 | 0.75 | Balance | 3.5 | — | Balance | Conventional example |
| 58 | 12 | Balance | 1.2 | 0.15 | 1.2 | 0.75 | Balance | 8 | 6.0 | Balance | Comparative example |
| 59 | 12 | Balance | 0.8 | 0.15 | 1.2 | 0.75 | Balance | 12 | — | Balance | Comparative example |

TABLE 8

| Alloy No. | Clad ratio (%) | | Final cold-rolling ratio (%) | Width A in FIG. 1 (μm) | Width B in FIG. 2 (μm) | Average crystal grain diameter after heat brazing (μm) | Corrosion test results (Constant current electrolysis test, 24 h) | | Remarks |
|---|---|---|---|---|---|---|---|---|---|
| | Filler material | Sacrificial material | | | | | Pitting corrosion *1 | Grain boundary corrosion *2 | |
| 43 | 9 | 13.5 | 18 | 45 | 7 | 230 | ◎ | ○ | This invention |
| | | | 40 | 44 | 7 | 103 | ○ | ○ | This invention |
| 44 | 10 | 15 | 20 | 40 | 5 | 195 | ◎ | ○ | This invention |
| | | | 45 | 41 | 6 | 95 | ○ | ○ | This invention |
| 45 | 12 | 16 | 25 | 53 | 10 | 180 | ◎ | ○ | This invention |
| | | | 40 | 52 | 9 | 105 | ○ | ○ | This invention |
| 46 | 14 | 18 | 25 | 54 | 9 | 185 | ◎ | ○ | This invention |
| | | | 40 | 52 | 8 | 100 | ○ | ○ | This invention |
| 47 | 10 | 13 | 18 | 45 | — | 230 | ◎ | ◎ | This invention |
| | | | 40 | 44 | — | 103 | ○ | ◎ | This invention |
| 48 | 10 | 15 | 20 | 40 | — | 195 | ◎ | ◎ | This invention |
| | | | 45 | 41 | — | 95 | ○ | ◎ | This invention |
| 49 | 11 | 14 | 25 | 55 | — | 185 | ◎ | ◎ | This invention |
| | | | 40 | 53 | — | 100 | ○ | ◎ | This invention |
| 50 | 13 | 13.5 | 25 | 54 | — | 180 | ◎ | ◎ | This invention |
| | | | 40 | 52 | — | 100 | ○ | ◎ | This invention |
| 51 | 11 | 15 | 20 | — | 5 | 195 | ◎ | ○ | This invention |
| | | | 45 | — | 6 | 95 | ○ | ○ | This invention |

TABLE 8-continued

| Alloy No. | Clad ratio (%) Filler material | Clad ratio (%) Sacrificial material | Final cold-rolling ratio (%) | Width A in FIG. 1 (μm) | Width B in FIG. 2 (μm) | Average crystal grain diameter after heat brazing (μm) | Corrosion test results (Constant current electrolysis test, 24 h) Pitting corrosion *1 | Corrosion test results (Constant current electrolysis test, 24 h) Grain boundary corrosion *2 | Remarks |
|---|---|---|---|---|---|---|---|---|---|
| 52 | 12 | 17 | 20 | — | 5 | 190 | ⊙ | ○ | This invention |
| | | | 45 | — | 6 | 90 | ○ | ○ | This invention |
| 53 | 11 | 14 | 30 | 40 | 5 | 165 | ○ | ○ | This invention |
| | | | 40 | 41 | 6 | 105 | ○ | ○ | This invention |
| 54 | 10 | 15.0 | 30 | 45 | — | 165 | ○ | ⊙ | This invention |
| | | | 40 | 44 | — | 105 | ○ | ⊙ | This invention |
| 55 | 15 | 19 | 30 | 50 | 10 | 160 | ○ | ○ | This invention |
| | | | 45 | 51 | 11 | 95 | ○ | ○ | This invention |
| 56 | 21 | 32 | 20 | 30 | 0 | 190 | X | X | Conventional example |
| | | | 45 | 27 | 0 | 96 | X | X | Conventional example |
| 57 | 21 | 32 | 20 | 25 | — | 200 | X | X | Conventional example |
| | | | 45 | 23 | — | 105 | X | X | Conventional example |
| 58 | 12 | 18 | 20 | 25 | 0 | 190 | X | X | Comparative example |
| | | | 45 | 23 | 0 | 96 | X | X | Comparative example |
| 59 | 21 | 31 | 20 | 33 | — | 200 | X | X | Comparative example |
| | | | 45 | 30 | — | 105 | X | X | Comparative example |

(Note)
*1 ⊙: No pitting corrosion was observed at all; ○: Quite shallow pitting corrosion was observed; X: Through hole pitting corrosion was observed.
*2 ⊙: No grain boundary corrosion was observed at all; ○: Quite slight grain boundary corrosion was observed; X: Grain boundary corrosion was observed.

From the results shown in Table 8, it can be understood that corrosion advanced through the entire tube thickness in the conventional examples and the comparative examples, but corrosion was limited in the outer half or around of the thickness in the tube sheet that can be used in the aluminum alloy heat exchanger of the present invention, showing good external corrosion resistance.

Having described our invention as related to the present embodiments, it is our intention that the invention not be limited by any of the details of the description, unless otherwise specified, but rather be construed broadly within its spirit and scope as set out in the accompanying claims.

What is claimed is:

1. An aluminum alloy heat exchanger having a tube, wherein the tube is composed of a thin aluminum alloy clad material, in which one face of an aluminum alloy core material having an Si content of 0.05 to 1.0% by mass is clad with an Al—Si-series filler material containing 5 to 20% by mass of Si, and in which the other face of the core material is clad with a sacrificial material containing at least one selected from the group consisting of 2 to 10% by mass of Zn and 1 to 5% by mass of Mg, and wherein an element diffusion profile of the aluminum alloy clad material after heating for brazing as determined by EPMA from a filler material side satisfies the following expression (1) when the sacrificial material contains Zn, and the following expression (2) when the sacrificial material contains Mg:

$$L-L_{Si}-L_{Zn} \geqq 40(\mu m) \quad (1)$$

wherein L represents a thickness (μm) of a wall of the tube;

$L_{Si}$ represents a position (μm) from a filler material surface of a cross point between an elongated line connecting a point corresponding to an Si content of 1.5% by mass and a point corresponding to an Si content of 1.0% by mass, and a line indicating the Si content of the core material, in the diffusion profile by EPMA from the filler material side; and $L_{Zn}$ represents a diffusion region (μm) from a sacrificial material surface, in which an amount of Zn diffused from the sacrificial material is 0.5% by mass or more;

$$L-L_{Si}-L_{Mg} \geqq 5(\mu m) \quad (2)$$

wherein L and $L_{Si}$ have the same meanings as those in the expression (1); and $L_{Mg}$ represents a diffusion region (μm) from a sacrificial material surface, in which an amount of Mg diffused from the sacrificial material is 0.05% by mass or more, wherein a thickness of the aluminum alloy clad material after heating for brazing is 0.23 mm or less, wherein an average crystal grain diameter of recrystallized crystals of the core material of the aluminum alloy clad material after heating for brazing is 180 μm or more; and wherein the aluminum alloy heat exchanger has a clad ratio of the filler material of 7% or more and less than 13%, and a clad ratio of the sacrificial material of 4% or more and less than 16.5%; or the aluminum alloy heat exchanger has a clad ratio of the filler material of 7% or more and less than 20%, and a clad ratio of the sacrificial material of 4% or more and less than 30%.

2. The aluminum alloy heat exchanger according to claim 1, wherein the sacrificial material contains 2 to 10% by mass of Zn, and wherein the element diffusion profile by EPMA satisfies the expression (1).

3. The aluminum alloy heat exchanger according to claim 1, wherein the sacrificial material contains 1 to 5% by mass of Mg, and wherein the element diffusion profile by EPMA satisfies the expression (2).

4. The aluminum alloy heat exchanger according to claim 1, wherein the sacrificial material contains 2 to 10% by mass of Zn and 1 to 5% by mass of Mg, and wherein the element diffusion profile by EPMA satisfies the expressions (1) and (2).

5. A method of producing an aluminum alloy heat exchanger, comprising the step of:

brazing under heating, which comprises: being kept at a temperature of 600±5° C. for 3 to 4 minutes in a nitrogen atmosphere, and cooling at a cooling down rate from 550° C. to 200° C. of 50±5° C./min, wherein the aluminum alloy heat exchanger has a clad ratio of the filler material of 7% or more and less than 13%, and a clad ratio of the sacrificial material of 4% or more and less than 16.5%, within the range of clad material components described in claim 1, wherein a thickness of the aluminum alloy clad material after heating for brazing is 0.23 mm or less, and wherein an average crystal grain diameter of recrystallized crystals of the core material of the aluminum alloy clad material after heating for brazing is 180 μm or more.

6. The method according to claim 5, wherein a reduction ratio in a final cold-rolling step among a plurality of cold-rolling steps to which the aluminum alloy clad material is subjected, is 25% or less.

7. A method of producing an aluminum alloy heat exchanger, comprising the step of:

brazing under rapid heating and cooling, which comprises: being kept at a target temperature of 600±5° C. for 3 to 4 minutes in a nitrogen atmosphere, in which a time for keeping at 400° C. or higher is less than 15 minutes, wherein the aluminum alloy heat exchanger has a clad ratio of the filler material of 7% or more and less than 20%, and a clad ratio of the sacrificial material of 4% or more and less than 30%, within the range of clad material components described in claim 1, wherein a thickness of the aluminum alloy clad material after heating for brazing is 0.23 mm or less; and wherein an average crystal grain diameter of recrystallized crystals of the core material of the aluminum alloy clad material after heating for brazing is 180 μm or more.

8. The method according to claim 7, wherein a reduction ratio in a final cold-rolling step among a plurality of cold-rolling steps to which the aluminum alloy clad material is subjected, is 25% or less.

* * * * *